United States Patent [19]

Cohen

[11] 4,216,743

[45] Aug. 12, 1980

[54] MAGNETICALLY UNLOCKED PET DOOR

[76] Inventor: Robert E. Cohen, 759 Harrison St., San Francisco, Calif. 94131

[21] Appl. No.: 910,093

[22] Filed: May 30, 1978

[51] Int. Cl.[2] ..... E05B 65/00

[52] U.S. Cl. ..... 119/19; 49/171

[58] Field of Search ..... 119/19, 51 R, 106; 49/394, 171; 160/179, 180; 340/152 T

[56] References Cited

U.S. PATENT DOCUMENTS

| | | | |
|---|---|---|---|
| 3,465,724 | 9/1969 | Broadbent | 119/51 R |
| 3,557,757 | 1/1971 | Brooks | 119/51 R |
| 3,816,709 | 6/1974 | Walton | 340/152 T |
| 3,897,753 | 8/1975 | Lee et al. | 119/51 R |
| 4,022,263 | 5/1977 | Beckett et al. | 160/179 |
| 4,047,331 | 9/1977 | Davlantes | 49/171 |

*Primary Examiner*—Jay N. Eskovitz

*Attorney, Agent, or Firm*—Freilich, Hornbaker, Wasserman, Rosen & Fernandez

[57] ABSTRACT

A magnetically actuated pet door is disclosed which allows only the owner's pet, such as a cat or dog, to enter. The door is hinged at the top to open in both directions for ingress and egress, but is prevented from opening in the ingress direction by a solenoid-actuated, one-way latch comprised of a plunger against the inside of a flap that is in turn hinged on the inside of the pet door, and held flat against the pet door by springs. A notch in the pet door behind the flap permits the door to swing freely open in the egress direction without the solenoid being energized to withdraw the plunger. A permanent magnet attached to the collar of a pet induces a signal in magnetosensitive devices disposed on the outside of the pet door. That signal is processed to energize the latch solenoid and thereby withdrawing the solenoid plunger from the path of the flap on the pet door to allow the pet to ingress.

6 Claims, 6 Drawing Figures

MAGNETICALLY UNLOCKED PET DOOR

BACKGROUND OF THE INVENTION

This invention relates generally to pet doors, and more particularly to magnetically actuated pet door locks to prevent ingress of unauthorized pets.

Pet doors are generally known in the prior art for allowing ingress and egress of pets, such as cats or dogs, from dwellings without the necessity of the owner letting the pet in or out. These doors provide the pet with freedom to come and go at will.

One type of pet door takes the form of a series of triangular plastic or rubber members arranged to form an iris. The pet can easily enter and exit the dwelling through the iris, but stray animals may also enter the dwelling. Another type of pet door utilizes flexible flaps over an opening for allowing the owner's pet to enter or exit. Single flaps have been used as shown in U.S. Pat. No. 3,184,802. Dual flexible flaps, mounted one within the other, have also been used. A smaller, inner flap is attached to a larger, outer flap which swings to one side only. The smaller flap rests against the lip of an opening through the larger flap so that it can swing to the other side only. The flaps also contain magnets and iron slugs or discs for holding the two flaps together while the outer flap swings to one side. The pet can thus pass through the opening in the outer flap in one direction and through a larger opening in the door in the other direction. The outer flap also has magnets molded along the bottom to keep it closed against iron slugs or discs until the pet pushes against it. The problem with these pet doors is that they allow stray animals to pass through the door.

In order to bar stray animals from passing through the pet door while allowing only one's own pet to pass, some latching scheme must be provided. One scheme disclosed in U.S. Pat. No. 4,022,263 employs a magnetic reed switch actuated by a permanent magnet attached to the pet's collar. The problem is that the magnet must come very close to the reed switch to close it. To assure that, a first iris-type door is provided, and the reed switch is mounted near the center of the iris. The actuated reed switch energizes a solenoid to unlock a hinged door beyond, thus allowing the owner's pet to enter in one direction. The lock is provided as a one-way latch to permit the pet to pass freely in the other direction. Such a system is relatively complex and costly to install because it requires a chamber having an iris-type door and a hinged door. Moreover, unless the magnet is in the proper position on the pet's neck to contact, or very nearly contact, the reed switch, it will not be actuated. Accordingly, it is an object of the present invention to provide an improved pet door and latch.

SUMMARY OF THE INVENTION

In accordance with the present invention, an electromagnetically actuated door latch is provided for a hinged pet door. A magnetic field detector composed of a pair of magneto-sensitive devices is placed on the outside of the pet door and a short distance in front of the door, one device on each side of a space that the pet will have to traverse to reach the door. The magnetic field detector responds to the field of a permanent magnet attached to the pet in any position around his neck and produces an electrical signal. An electronic circuit is responsive to the signal thus produced for generating a pulse of predetermined duration to unlatch the pet door latch means and hold it unlatched for a period sufficient for the pet to push the door open in passing from the outside to the inside. The latch means is a one-way latch that permits free egress.

DESCRIPTION OF PREFERRED EMBODIMENTS

Figure 1:
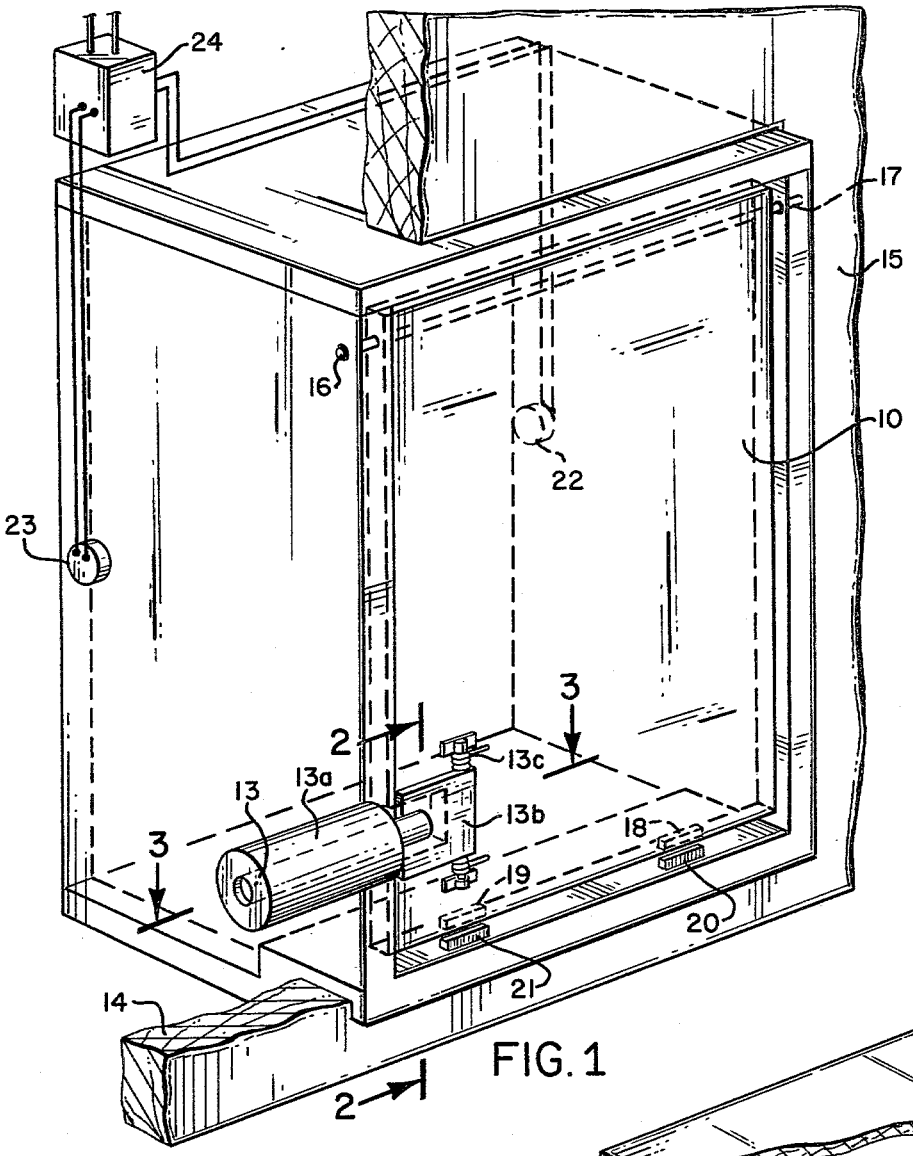
FIG. 1 is an isometric view of a pet door according to an exemplary embodiment of the present invention.

Referring now to FIG. 1, a pet door 10 is provided with a latch mechanism which, according to a preferred embodiment of the invention, includes a permanent magnet 11 attachable to a collar 12 of a pet and an electromagnetic (solenoid actuated) door latch 13. The pet door 10 may be installed in a wall panel of a dwelling, or in a door panel 14 as shown.

Figure 2:
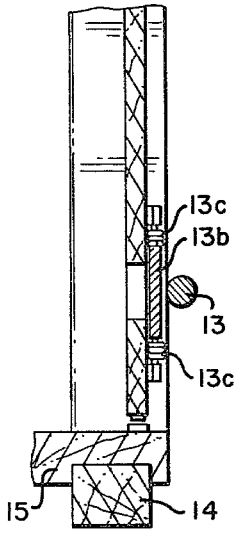
FIG. 2 is a sectional view taken on a line 2—2 of FIG. 1.

The pet door 10 is hinged at the top from a frame 15 mounted in the door panel 14. With the pet door latch 13 actuated, the pet door may swing only outward (from right to left in FIG. 2) to allow a pet only egress. For ingress, the pet must cause a solenoid **13*a* for the latch 13 to be energized to retract the latch 13 from the path of a hinged flap 13*b*. Springs 13*c* hold the flap 13*b* flat against the inside (right side in FIG. 2) of the pet door 10**.

The pet door 10 is preferably made of a rigid material. Molding members may surround the frame 15 to better secure the frame in the door 14. The ends 16 and 17 of a rod through the top of the pet door 10 are inserted into the frame 15 on each side to serve as a suitable pivot. Alternatively a piano hinge between the top of the pet door and the frame may be employed.

As the door 10 is opened outwardly (to the left in FIG. 2) and released while the latch 13 is still drawn back, the door 10 will tend to swing back and forth past its vertical (closed) position. For the best operation of the latch 13, this pendulum motion should be damped, although that is not necessary because the flap **13*b* will ride over the latch 13 in one direction. Several damping mechanisms may be employed. For example, iron slugs or discs 18 and 19 may be installed on the bottom of the pet door 10 so that they react with magnets 20 and 21 attached to the bottom of the frame 15 to slow the swinging action of the door 10 and bring it to rest in a vertical position. This type of magnetic damping mechanism would not interfere with the operation of the latch mechanism since the magnets 20 and 21** are stationary.

A magnetic field detector comprised of a pair of magnetodiodes 22 and 23 detects any change in magnetic flux caused by the entry of the permanent magnet 11 on the pet's collar 12 into the space between the magnetodiodes as the pet approaches the pet door. That induces a signal in a control unit 24 to unlatch the door by energizing the solenoid **13*a***.

Figure 4:
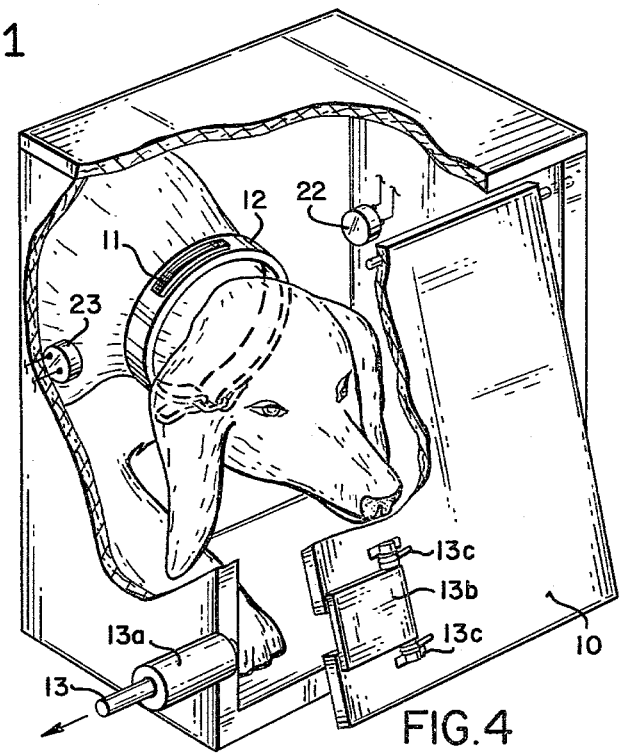
FIG. 4 illustrates the pet door in use by a dog.

The energized solenoid retracts the latch 13 against the force of a torsional spring 13*d* in a conventional manner to permit ingress for a pet carrying a magnet as shown in FIG. 4.

Figure 3:
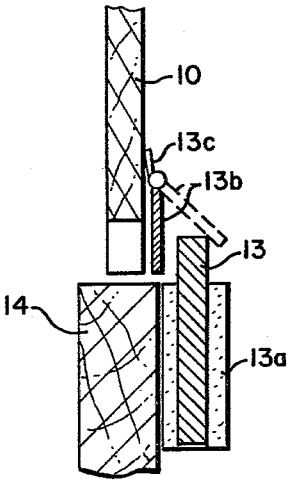
FIG. 3 is a sectional view taken on a line 3—3 of FIG. 1.

FIG. 3 illustrates the manner in which the hinged flap 13*b* will permit the pet door 10 to swing past the latch 13 even if the solenoid 13*a* should be deenergized before the pet door stops its pendulum motion and is brought to rest in a vertical position. The flap 13*b* simply rides over the latch 13 as the pet door swings outwardly (to the left in FIG. 3). On its return inward swing, the flap 13*b* will engage the latch. That will stop the pendulum motion and latch the pet door to prevent ingress by any animal not carrying a magnet on its collar, but permitting egress.

Figure 5:
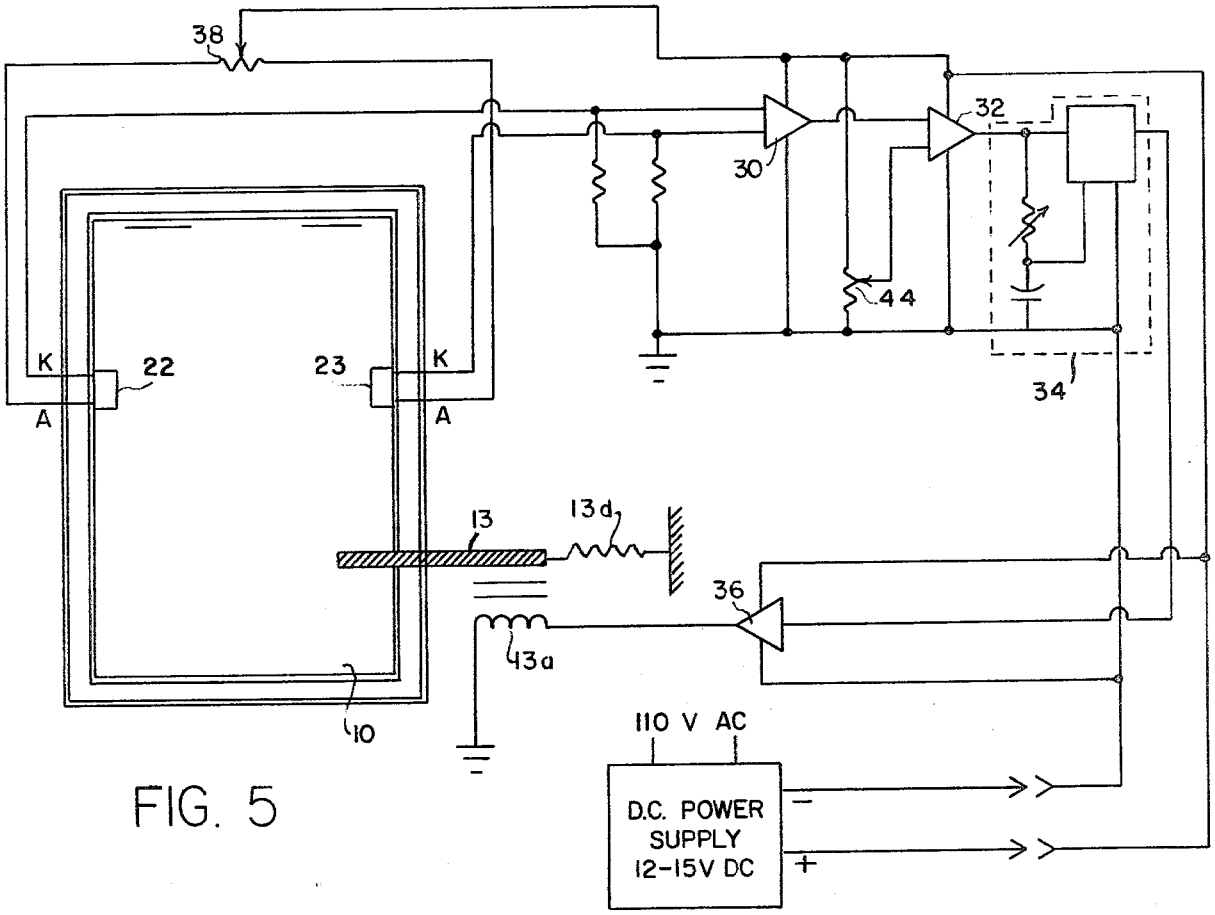
FIG. 5 is a schematic diagram of the electromagnetically actuated door latch system.

The electronic control unit 24 shown in FIG. 5 is comprised of a differential amplifier 30, a comparator 32, a timing circuit 34 and a current amplifier 36. The differential amplifier will detect and amplify small voltage signal differences induced in the magnetodiode pair to cause the comparator to transmit a distinct stepwave of predetermined amplitude. The step-wave then turns on the timing circuit 34 to energize the solenoid and retract the latch 13 against the force of the spring 13*d*. The timing circuit holds the amplifier 36 on for a predetermined period, even after the step-wave returns to its steady state (quiescent level) once pet has passed through the door so that the field of the magnet no longer has an effect on the magnetodiodes. In other words, the period of the timing circuit is set to be at least sufficient to allow the pet to move the door 10 past the retracted latch 13 as shown in FIG. 4. Power for the control unit is provided from a line voltage of 110 V AC by a DC power supply unit 38 comprised of a low voltage transformer and an AC to DC converter (rectifier and filter).

After the pet has passed through the door, the door will swing back like a pendulum. As the metal plates 18 and 19 swings past the magnets 20 and 21, the magnets attract the plates and thereby dampen the door's motion and bring it to a stop in the vertical position. If the door is still swinging after the end of the timing period of the circuit 34, i.e. after the solenoid 13*a* is deenergized to allow the latch 13 to spring back into the locking position, the hinged flap 13*b* will simply ride over the latch 13 as noted hereinbefore.

Figure 6:
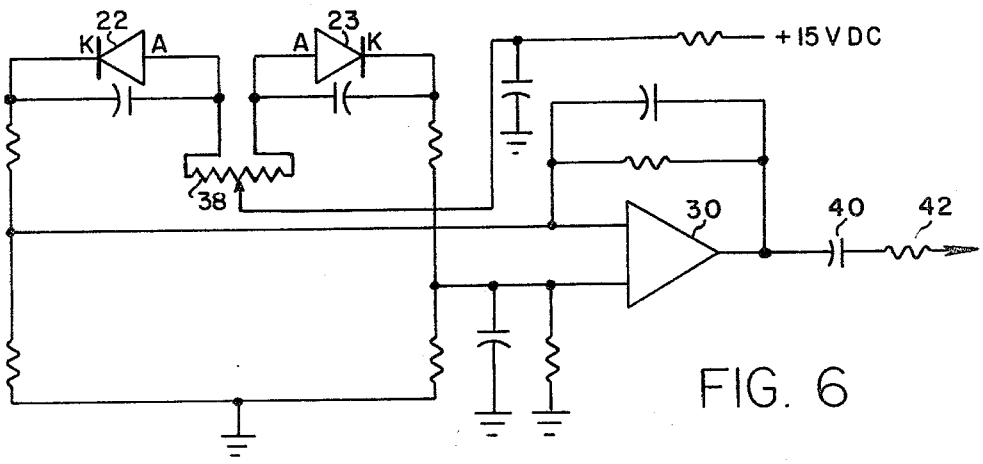
FIG. 6 is a diagram of an exemplary circuit for the magnetic field detection portion of the system of FIG. 5.

FIG. 6 is a more detailed circuit of the magnetic field detector, namely the magnetodiodes 22 and 23 connected to the differential amplifier 30. The operation of these magnetosensitive devices is as follows: when the pet is within the proximity of the door 10 (approximately six inches), the magnet on the pet's collar will be in the general space between the magnetodiodes. The presence of an altered magnetic field will change the current-voltage (I-V) characteristic of the magnetodiodes. Initially the I-V characteristics are balanced by a potentiometer 38 to provide a zero-volt output at the output of the differential amplifier 30. Any change in the I-V characteristic of the magnetodiodes will thus produce a change in the zero-volt output. That change is AC coupled by a capacitor 40 and resistor 42 to the comparator 32 (FIG. 5) which is adjusted by a potentiometer 44 for the desired sensitivity of the control unit.

Suitable magnetosensitive devices are commercially available. Typical magnetodiodes made by Sony Corp. are available from Shigma Inc., Park Ridge, Illinois. In the circuit, these devices are essentially semiconductor diodes forward biased for equal conductivity through the balancing potentiometer 38. The semiconductor diodes are purposely fabricated to have I-V characteristics that are sensitive to an applied magnetic field. They are available in matched pairs (part No. M023A) to facilitate using them in this differential mode for greater sensitivity. However, other magnetosensitive devices may be used. Consequently, it is intended that use of the term magnetosensitive devices be construed to include all devices operating functionally in the same or analagous manner, either individually or in differential pairs.

In summary, it may be seen that an automatic pet door system utilizes a magnet field detector to detect the presence of a magnet on a pet's collar. The magnet need only pass within 6 inches of the detector in order to trigger the latch. Operation of the present invention does not depend upon the position of a magnet about a pet's neck. The detector actuates an electromagnetic latch to unlock the pet door thereby permitting the pet to pass through the door. A pet not carrying a magnet will not be able to pass through the door. Thus, with the pet door in the latched condition, stray animals are effectively barred from passing through the door.

Although a particular embodiment of the invention has been described and illustrated herein, it is recognized that modifications and variations may readily occur to those skilled in the art. It is therefore intended that the claims be interpreted to cover such modifications and variations.

What is claimed is:

1. In a door hinged at the top for permitting ingress and egrees of a pet, an electromagnetically controlled latch for preventing the door to swing open in the egress direction, and a magnetically controlled circuit for energizing said latch in response to a magnetic field of a permanent magnet carried on the body of said pet, said circuit being comprised of first and second magneto diodes for producing respective first and second current signals proportional to the magnetic flux present at the positions of said magnetodiodes, said magnetodiodes being positioned on opposite sides of said door, and amplifying means for producing a signal proportional to the difference between said first and second signals to energize said latch in response to a predetermined minimum change in magnetic flux, said amplifying means being comprised of a differential amplifier connected to said magnetodiodes to produce a signal proportional to the difference between said first and second current signals produced by said first and second magnetodiodes.

2. The combination of claim 1 including means responsive to said differential amplifier output signal for producing a step-wave output signal of predetermined amplitude while said differential amplifier output signal exceeds a predetermined reference signal.

3. The combination of claim 2 including timing means responsive to said step-wave output signal for producing a control signal of predetermined duration and power amplifying means responsive to said control signal for energizing said electromagnetically controlled latch for said predetermined period.

4. The invention according to claim 1 including damping means for stopping said door in a vertical position.

5. The invention according to claim 4 wherein said damping means comprises at least one permanent magnet secured to the bottom of a frame around said door in a position below said hinged door in the vertical position, and magnetically attached metal secured to the bottom of the door opposite said secured permanent magnet.

6. The invention according to claim 5 wherein said electromagnetic latch means is comprised of a solenoid having an armature extending into the path of said hinged door, and said hinged door having a slot to allow the door to swing past said armature, said latch means being further comprised of a plate covering said slot and hinged to swing out of the way as said door swings past said armature, and a spring to bias said plate into a position over said slot.

* * * * *